United States Patent [19]

Schuster

[11] 3,974,927

[45] Aug. 17, 1976

[54] SIDE SHIFTER ASSEMBLY FOR LIFT TRUCKS

[75] Inventor: Frank C. Schuster, Peoria, Ill.

[73] Assignee: Little Giant Products, Inc., Peoria, Ill.

[22] Filed: July 15, 1974

[21] Appl. No.: 488,222

[52] U.S. Cl. ..... 214/730; 308/3 R

[51] Int. Cl.[2] ..... B66F 9/14

[58] Field of Search ..... 214/730, 731, 750; 308/3 R, 3 A, 3 B, 3.5, DIG. 8

[56] References Cited

UNITED STATES PATENTS

| | | | |
|---|---|---|---|
| 1,685,434 | 9/1928 | Parkes | 308/3 A |
| 2,104,299 | 1/1938 | Grundstein | 308/3 R |
| 2,456,320 | 12/1948 | Repke | 214/750 |
| 2,748,966 | 6/1956 | Gohrke | 214/731 |
| 2,822,101 | 2/1958 | Schenkelberger | 214/730 |
| 2,910,204 | 10/1959 | Wight | 214/730 |
| 3,075,665 | 1/1963 | Repke | 214/731 |
| 3,106,305 | 10/1963 | Gehring | 214/730 |
| 3,460,700 | 8/1969 | Kroupa | 214/730 |
| 3,819,078 | 6/1974 | Walsh | 214/730 |

*Primary Examiner*—Robert J. Spar
*Assistant Examiner*—Lawrence J. Oresky

[57] ABSTRACT

A side shifter for lift trucks embodying a bearing structure including a replaceable wear bar arranged to increase the wearable life of its bearing surface and including a hydraulic piston - cylinder assembly mounted in a novel manner to increase the maximum capacity of the lift forks or platform.

9 Claims, 4 Drawing Figures

SIDE SHIFTER ASSEMBLY FOR LIFT TRUCKS

The invention relates to improvements in lift trucks having a side shifter fork or other platform, and is particularly concerned with the novel means for mounting the side shifter so as to reduce initial and part replacement costs by increasing wearability of the load bearing surfaces embodied in the mounting of the side shifter on its carriage.

Heretofore, side shifters were mounted directly on the carriage, and because of the wear resulting from load and constant shifting of the side shifter relative to the carriage, the assembly required early replacement of the carriage and/or of the side shifter. This disadvantage is overcome by the herein disclosed use of removable wear bars, which, prior to being discarded as too badly worn for further use, may be repositioned in their mounting to present entirely new wear surfaces. Also, the wear bar is so positioned in its mounting that the accummulation of foreign matter on its wear surfaces is minimized.

The hydraulic cylinder-piston assembly used to effect side shifting preferably is mounted on spherical bearing mountings in a space between the mounting bars on the lift truck carriage so as to protect the cylinder, hold to a minimum lost load center and insure maximum carriage headroom, thus retaining maximum capacity for the lift element. Preferably, this mounting is midway between the upper and lower slide bearing opposing (friction) forces, to provide optimum force effectiveness.

It is therefore an object of the invention to provide a structure of the character referred to.

Another object is to provide a side shifter assembly with novel wear bars.

Another object is to provide wear bars that may be repositioned to increase their useful life.

Another object is to provide elongated horizontally arranged wear bars which are removably mounted on a vertically movable member in a manner to utilize the full length of the bars and thus increase their useful life.

Another object is to utilize the space normally available between the upper and lower truck carriage bars for mounting the hydraulic piston-cylinder assembly.

Another object is to provide an assembly of the character referred to which is not expensive to construct, easy and inexpensive to retain serviceable, and very efficient in use.

Other advantages and objects of the invention will become apparent with reference to the following description and the accompanying drawings.

Figure 1:
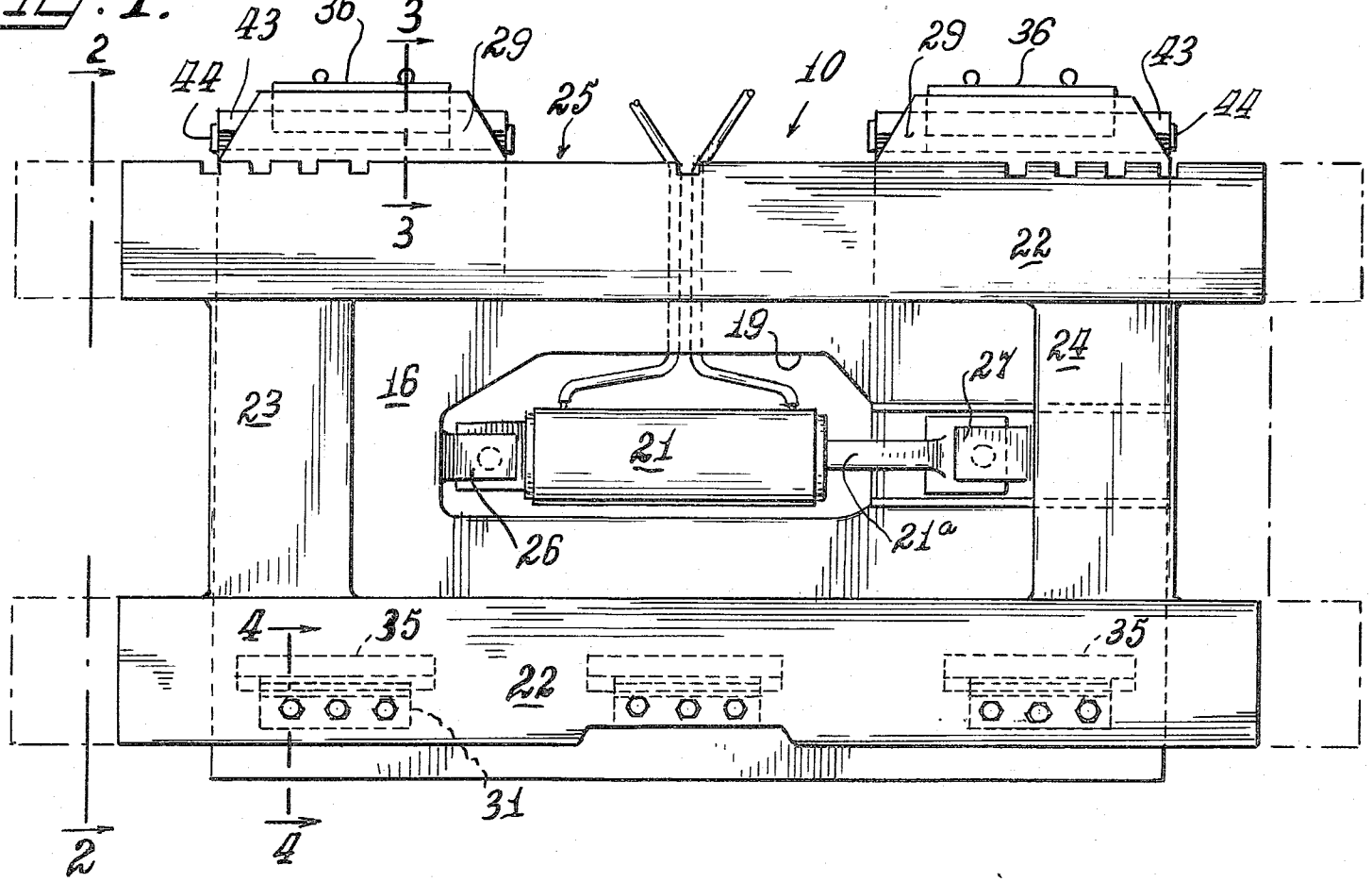
FIG. 1 is a front elevational view of the side shifter assembly with the lift fork omitted.

Referring to the exemplary embodiment of the invention shown in the accompanying drawings, the side shifter assembly 10 is mounted on a carriage 11 that is mounted for vertical movement on a conventional mast 12 carried on the front or lead end of a lift truck 13 or the like. The carriage 11 has a flat front face upon which is securely mounted a pair of vertically spaced apart carriage bars 14, suitably formed on their respective upper and lower edges with an offset 15 defining a mitered edge. A face plate 16 overlies the carriage bars and is connected to said carriage bars by clamps 17 on its lower margin that embraces the bottom offset 15; and a clamp or bearing block 18 on its upper margin that embraces the top offset 15. The face plate 16 has a substantially centrally located horizontally elongated cut-out 19 to permit locating a hydraulic piston-cylinder assembly 21 as close to the carriage 11 as possible, for a purpose to be made apparent presently.

A pair of horizontally extending vertically spaced apart fork mounting bars 22 are arranged over the exposed front face of the face plate 16, as best shown in FIG. 1. These bars are rigidly connected one to the other by vertical tie bars 23 and 24, so as to provide a rigid substantially rectangular horizontal shift frame structure 25.

The cylinder 21 is mounted within the cut-out 19 at one end by a self-aligned spherical bearing connection 26 carried on face plate 16. Its piston rod **21*a* is connected also by a self aligned spherical bearing connection 27 to the tie bar 24. It is thus apparent that when the piston rod 21*a* moves outwardly of the cylinder 21, the frame structure 25 is shifted horizontally as a unit in one direction, as per the broken lines in FIG. 1, and, when moved inwardly, the said frame structure is shifted in the opposite direction. Because the lift form or other auxiliary attachment or platform 28 is secured to the horizontally shiftable frame structure 25, the said fork or attachment or platform is shifted sidewise in response to shifting of the frame structure. To accomplish such side shifting, the frame structure is slidably supported on the face plate 16**.

Figure 4:
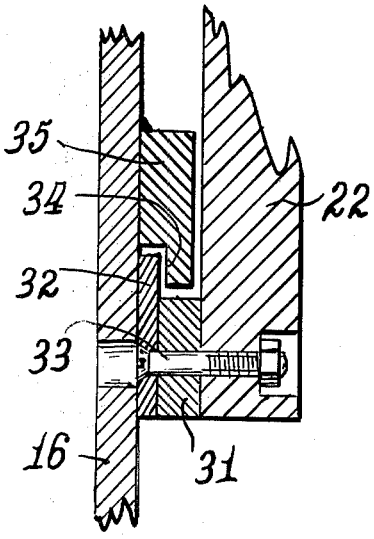
FIG. 4 is an enlarged detail sectional view taken substantially on line 4 — 4 of FIG. 1.

To this end, the upper bar 22 of the frame structure 25 has secured to its surface facing the face plate 16, as by welding, guide support plates 29; whereas guide bars 31 are secured, as by a bolt 33, to the related surface of the lower bar 22. The guide bar 31 (see FIG. 4) carries on its exposed surface a wear strip 32 that is secured thereto by the bolt 33. The upper margin of the wear strip 32 is engaged in a recess 34 provided in the bottom edge of an anchor plate 35 that is secured, as by welding, to the opposed face of the face plate 16. This structure serves to hold the lower bar 22 in place against the face plate 16, and when worn the wear strip may be easily replaced.

Figure 3:
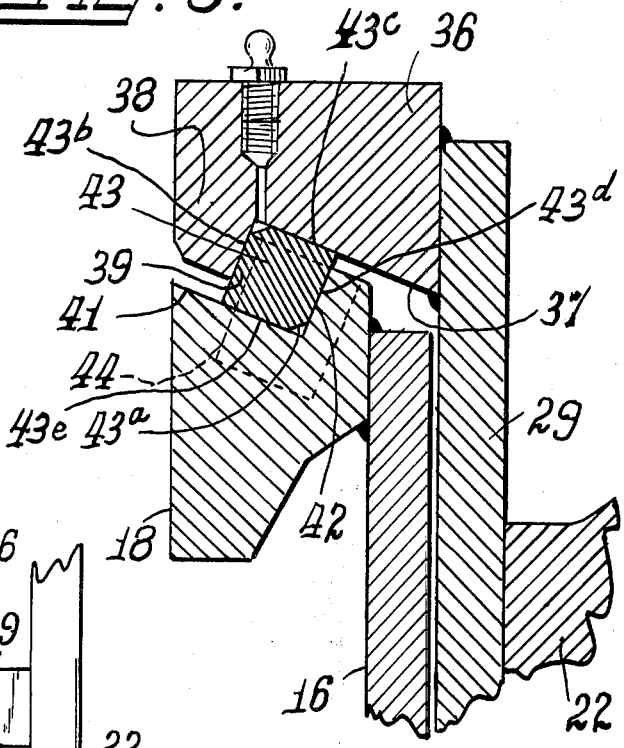
FIG. 3 is an enlarged detail sectional view taken substantially on line 3 — 3 of FIG. 1.
Figure 2:
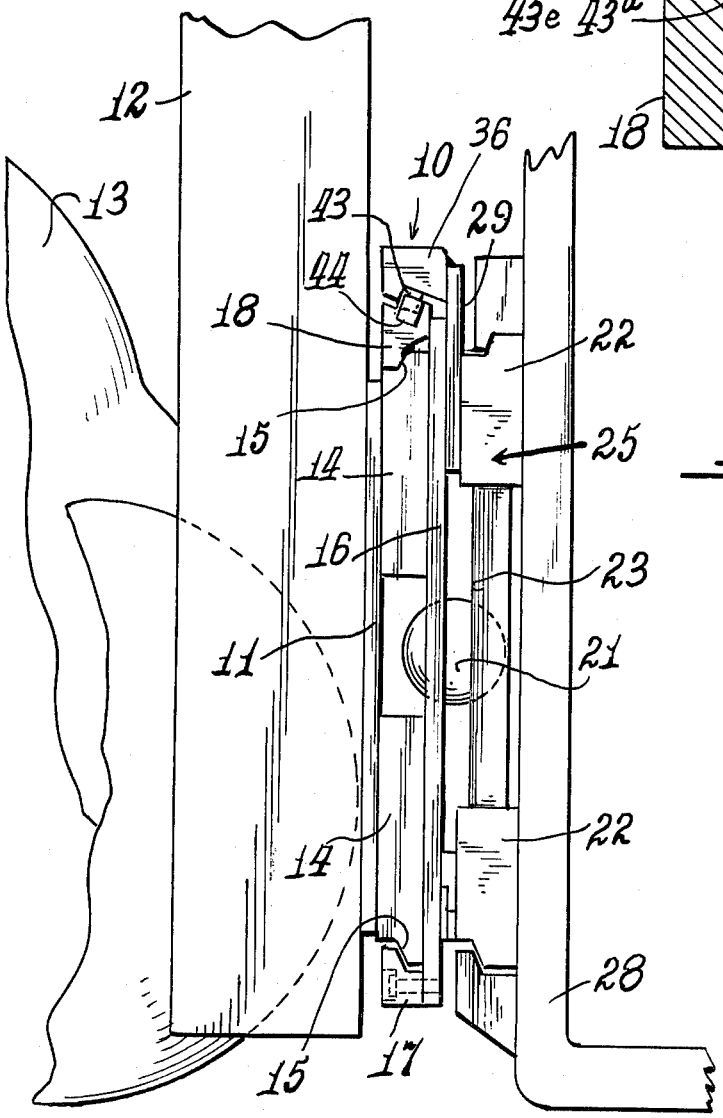
FIG. 2 is an end elevational view of the assembly, viewed along line 2 — 2 of FIG. 1, showing the lift fork mounted thereon.

The guide support plates 29 integral with the upper bar 22, as shown in FIG. 3, has welded or otherwise secured to the face thereof facing the plate 16 and at its upper margin, a slide bearing 36 having its bottom face 37 inclined upwardly away from plate 29 and terminating in a shoulder 38 having a surface 39 perpendicular to the face 37. The face plate 16 has the clamp or bearing blocks 18 welded to its front or back face. This block has an inclined upper surface 41, parallel to face 37, and a shoulder providing a perpendicular surface 42 parallel to surface 39. Loosely seated on the clamp block surfaces 41 and 42 is a wear bar 43 fabricated from square alloy bronze stock or other anti-friction bearing material, and upon which rests the surfaces 37 and 39 of slide bearing 36. The wear bar 43 is of substantially the same length as the support block 18 and longitudinal sliding of the wear bar 43 is prevented by end caps 44 secured, as by welding, to the ends of said support block. Preferably, two opposed longitudinal corners **43*a*** of the wear bar are removed.

Because of the angular optimum position of the wear bar 43, forces generated when supporting the overhanging load of the frame structure 25 are distributed over two upper surfaces of the wear bar 43. When wear occurs, at 43*b* and 43*c*, the wear bar may be reversed in its mounting to present two new wear surfaces 43*d* and 43*e* for the slide bearing 36. Also, because of the angular disposition of the wear bar, said bar presents self cleaning surfaces which tend to reject foreign objects and dirt; and the lateral shifting motion of the slide bearing 36 assists in self cleaning of the wear bar 43.

To mount the frame structure 25 on the face plate 16, the wear bar 43 is seated in place on the clamp block 18, whereupon the slide bearing 36 on the frame structure is engaged over the wear bar as shown. The lower guide bars 31 and their related wear strips 32 are then arranged in place on the back side of the lower end of the frame structure 25 and bolts 33 are inserted freely through a suitable opening in the face plate to secure the bars 31 and strips 32 firmly to the frame structure. With the strips 32 engaged in the recesses 34 on anchor plate 14, the assembly is held firmly for lateral sliding and vertical displacement is prevented.

Although I have described a preferred embodiment of my invention in considerable detail, it will be understood that the description thereof is intended to be illustrative and not restrictive, as details of the structure may be modified or changed without departing from the spirit or scope of the invention. Accordingly, I do not desire to be restricted to the exact construction described and shown.

I claim:

1. In a side shifter assembly for a lift truck having a vertically movable carriage, said assembly comprising: a vertically disposed face plate adapted for securement on said carriage and for movement therewith, a bearing block member on the upper end of said face plate, a horizontally shiftable frame structure, means slidably connecting the lower portion of said frame structure to said face plate, a slide bearing member on the upper end of said frame structure overlying said bearing block member, a recess arranged between said members, an elongated wear bar arranged in the recess, said recess being closed at its ends to prevent longitudinal shifting of the wear bar, and a load carrying structure carried by said frame structure said wear bar being shaped so that upon turning it relative to said recess, surfaces of the wear bar and said recess each continue to have angularly disposed longitudinal surfaces in registering alignment with one another whereby the shifting path of the frame relative to said face plate is the same irrespective of said turning.

2. The assembly recited in claim 1, wherein the wear bar is substantially square in cross section.

3. The assembly recited in claim 2, wherein the elongated square wear bar is set at an angle to position two adjoining surfaces for seating the slide bearing thereon.

4. In a side shifter assembly for a lift truck having a vertically movable carriage, said assembly comprising: a vertically disposed face plate adapted for securement on said carriage and for movement therewith, a bearing block member on the upper end of said face plate, a horizontally shiftable frame structure, means slidably connecting the lower portion of said frame structure to said face plate, a slide bearing member on the upper end of said frame structure overlying said bearing block member, a recess arranged between said members, an elongated wear bar arranged in the recess, said wear bar having a polygonal cross-section and at least two sets of opposed parallel longitudinal sides, and a load carrying structure carried by said frame structure said wear bar being shaped so that upon turning it relative to said recess surfaces of the wear bar and said recess each continue to have angularly disposed longitudinal surfaces in registering alignment with one another whereby the shifting path of the frame relative to said face plate is the same irrespective of said turning.

5. The assembly recited in claim 4, wherein both the bearing block and the slide bearing have registering longitudinal surfaces to receive the wear bar therein.

6. In a side shifter assembly for a lift truck having a vertically movable carriage, said assembly comprising: a vertically disposed face plate adapted for securement on said carriage and for movement therewith, a bearing block member on the upper end of said face plate, a horizontally shiftable frame structure, means slidably connecting the lower portion of said frame structure to said face plate, a slide bearing member on the upper end of said frame structure overlying said bearing block member, a recess arranged between said members, an elongated wear bar arranged in the recess, said wear bar and said recess having registering surfaces, each of which has two longitudinal surfaces disposed angularly to one another and to the plane of the shifting axis of said frame structure for maintaining said slide bearing member positioned relative to said bearing block member, said wear bar being shaped so that upon turning it relative to said recess, surfaces of the wear bar and said recess each continue to have angularly disposed longitudinal surfaces in registering alignment with one another whereby the shifting path of the frame relative to said face plate is the same irrespective of said turning and a load carrying structure carried by said frame structure.

7. The assembly recited in claim 6, wherein the bearing block secures the upper end of the face plate to the carriage.

8. The assembly recited in claim 6, wherein a longitudinal edge between said surfaces of the wear bar are flattened.

9. The assembly recited in claim 4, wherein the wear bar is symmetrical about a line joining its opposite corners and reversible top to bottom by turning it about its longitudinal axis.

* * * * *